US009394705B2

(12) United States Patent
Tichell Fortea

(10) Patent No.: US 9,394,705 B2
(45) Date of Patent: Jul. 19, 2016

(54) MOVABLE CENTRING FOR PORT PLATFORMS

(71) Applicant: RUBRICA INGENIERIA Y ARQUITECTURA, S.L., Castellon de la Plana (Castellon) (ES)

(72) Inventor: Enrique Tichell Fortea, Castellon de la Plana (ES)

(73) Assignee: RÚBRICA INGENIERÍA y ARQUITECTURA, S.L., Castellón (ES)

( * ) Notice: Subject to any disclaimer, the term of this patent is extended or adjusted under 35 U.S.C. 154(b) by 124 days.

(21) Appl. No.: 14/240,423

(22) PCT Filed: Jan. 17, 2013

(86) PCT No.: PCT/ES2013/070015
§ 371 (c)(1),
(2) Date: Feb. 24, 2014

(87) PCT Pub. No.: WO2014/111601
PCT Pub. Date: Jul. 24, 2014

(65) Prior Publication Data

US 2015/0176293 A1 Jun. 25, 2015

(51) Int. Cl.
*E01D 21/00* (2006.01)
*E02B 3/06* (2006.01)
(Continued)

(52) U.S. Cl.
CPC ..... *E04G 11/28* (2013.01); *E04G 17/16* (2013.01); *E01D 21/00* (2013.01)

(58) Field of Classification Search
CPC ..... E04G 11/28; E04G 17/16; E02B 3/06; E01D 21/00; E02D 27/10
USPC ..... 425/63; 405/195.1, 229
See application file for complete search history.

(56) References Cited

U.S. PATENT DOCUMENTS 3,614,048 A * 10/1971 Young ..... B28B 7/0032 249/18
4,103,861 A 8/1978 Buchler et al.
2012/0004659 A1 1/2012 Miller et al.

FOREIGN PATENT DOCUMENTS

CN 201962605 9/2011
DE 1263806 3/1968
(Continued)

OTHER PUBLICATIONS

International Search Report issued Oct. 11, 2013 in International (PCT) Application No. PCT/ES2013/070015.

*Primary Examiner* — Alison L Hindenlang
*Assistant Examiner* — Jerzi H Moreno Hernandez
(74) *Attorney, Agent, or Firm* — Brown & Michaels, PC

(57) ABSTRACT

Movable centring for platforms in ports which comprises a mobile structure (1) with various formworks (2) and is supported on piles (3). The support of the mobile structure (1) on the piles (3) is carried out by means of, at least, two supporting devices (5), wherein each supporting device (5) comprises one front supporting beam (**6*d*), which comprises at least two coupling pieces (18), one rear supporting beam (6*t*) which comprises at least two coupling pieces (18) and a lattice (7), beneath each supporting beam (6*d*, 6*t*). The two supporting beams (6*d*, 6*t*) are joined together by means of the at least two coupling pieces (18), thus leaving the supporting device (5) fixed to the pile (3) by means of this union, and joining each supporting beam (6*d*, 6*t*) to the mobile structure (1) by means of, at least, two vertical latching bars (8**).

6 Claims, 7 Drawing Sheets

(51) Int. Cl.
*E04G 11/28* (2006.01)
*E04G 17/16* (2006.01)

(56) References Cited

FOREIGN PATENT DOCUMENTS

| | | | | | |
|---|---|---|---|---|---|
| ES | 2 249 649 | | | 4/2006 | |
| ES | 2 387 208 | | | 9/2012 | |
| ES | 2398177 | | | 3/2013 | |
| FR | 546289 | | | 11/1922 | |
| FR | 1522923 | | | 4/1968 | |
| FR | 1570648 | | | 6/1969 | |
| GB | 946548 | | | 1/1964 | |
| GB | 1509440 | A | * | 5/1978 | ..... E01D 21/00 |
| NO | 153502 | | | 12/1983 | |
| WO | 2009/043750 | | | 4/2009 | |
| WO | 2013149771 | | | 10/2013 | |

* cited by examiner

MOVABLE CENTRING FOR PORT PLATFORMS

OBJECT OF THE INVENTION

The present invention relates to a centring on which a formwork is supported for the construction of platforms in ports, where the centring is a movable centring, so that it makes the formwork advance without the need for other auxiliary structures.

The invention is applicable to the construction of civil works, more specifically to the construction of port platforms, which stand on piles installed in the seabed.

Technical Problem to be Solved

Formwork supporting structures where the concrete is in turn poured are employed in the construction of port platforms.

Supporting structures are currently placed hanging or held by means of a second structure placed above the supporting structure, to hang this structure it is necessary to install a series of braces and beams along the length of the platform.

In the state of the art, document GB 1509440 A is known, disclosing a mobile formwork for the construction of bridges. Said formwork is supported on jacks, during the concreting, and on rollers, which are employed to move the formwork to the next concreting position. In this document, the jacks as well as the rollers are supported on pier caps fixed to the piers of the bridge.

Likewise, in the state of the art, the document ES 2387208 A1 is known, whose holder is the same as that of the present application, and which discloses a shuttle device whose features are similar to the device disclosed in the present patent application. In this device, in order to remove the formwork, it is necessary for an operator to get under the aforementioned formwork, thus when the water level is high, this impedes carrying out said operation, or at best, makes it more difficult and slows it down.

The construction of the platforms is carried out sequentially, in such a way that once the concrete has gained resistance and has hardened, the formwork supporting the structure is moved to a new position for a new concrete pouring and to repeat this process until the construction of the platform is complete.

DESCRIPTION OF THE INVENTION

The invention described discloses a movable centring for platforms in ports, which comprises a mobile structure comprising in turn various formworks and that is supported on piles.

The support of the mobile structure on the piles is achieved by means of, at least, two supporting devices. Each supporting device comprises:

- a front supporting beam which comprises at least two coupling pieces;
- a rear supporting beam which comprises at least two coupling pieces;
- a lattice, beneath each supporting beam, which provides rigidity to the supporting beam.

The two supporting beams are joined together by means of, the at least two coupling pieces, thus leaving the supporting device fixed to the pile by means of this union. Each supporting beam is joined to the mobile structure by means of, at least, two vertical latching bars.

The front supporting beam comprises supporting plates and advance rollers, and the rear supporting beam comprises fixed supporting plates, in such a way that the mobile structure is supported on the supporting plates of the two supporting beams, when the mobile structure is in the static position, and is supported on the advance rollers of the front supporting beam during the movement of said mobile structure, the rear supporting beam having been lowered in relation to the static position by means of the vertical latching bars.

In the movable centring for platforms in ports, the supporting beams comprise at least two nuts into which the vertical latching bars are screwed, in such a way that the supporting beams move in a vertical direction by means of a rotating movement of the vertical latching bars.

In the movable centring for platforms in ports, the coupling pieces reproduce at least partially the external geometry of the pile, so two opposite coupling pieces are joined together by means of tying bars, fixing the supporting beams to the piles.

In the movable centring for platforms in ports, the coupling pieces comprise threaded holes into which the tying bars are introduced, which block their relative movement by means of nuts.

In the movable centring for platforms in ports, the advance rollers comprise a height regulation mechanism. Said height regulation mechanism comprises: a track, at the end of which the advance roller is located, a threaded hole located at the front supporting beam, a threaded bar joined to the track at one of its ends and which is introduced into a threaded hole of the front supporting beam.

The track is blocked by screwing a nut onto the end of the threaded bar which passes through the threaded hole.

In the movable centring for platforms in ports, the mobile structure comprises pairs of longitudinal beams brought together by means of a group of trusses, which make the mobile structure rigid. Said longitudinal beams lean against the supporting plates, in the static position of the mobile structure, or against the advance rollers during the movement of the aforementioned mobile structure.

DESCRIPTION OF THE FIGURES

To complete the description and with the aim of helping to achieve a better comprehension of the characteristics of the centring, a series of figures accompany this specification, wherein with illustrative and non-limitative character, the following has been represented.

Next, a list with the numerical references used in the figures is provided, which show the centring, which is the object of the invention:

1.—mobile structure;
2.—formwork;
3.—piles;
4.—supporting plates;
5.—supporting devices;

6*d*.—front supporting beam;
6*t*.—rear supporting beam;
7.—lattice;
8.—vertical latching bars;
9.—advance rollers;
10.—tying bars;
11*a*, 11*b*, 11*c*.—nut;
12.—threaded holes;
13.—track;
14.—threaded bar;
15.—longitudinal beams;
16.—trusses;
17.—through hole;
18.—coupling piece.

DETAILED DESCRIPTION OF THE INVENTION

Figure 1:
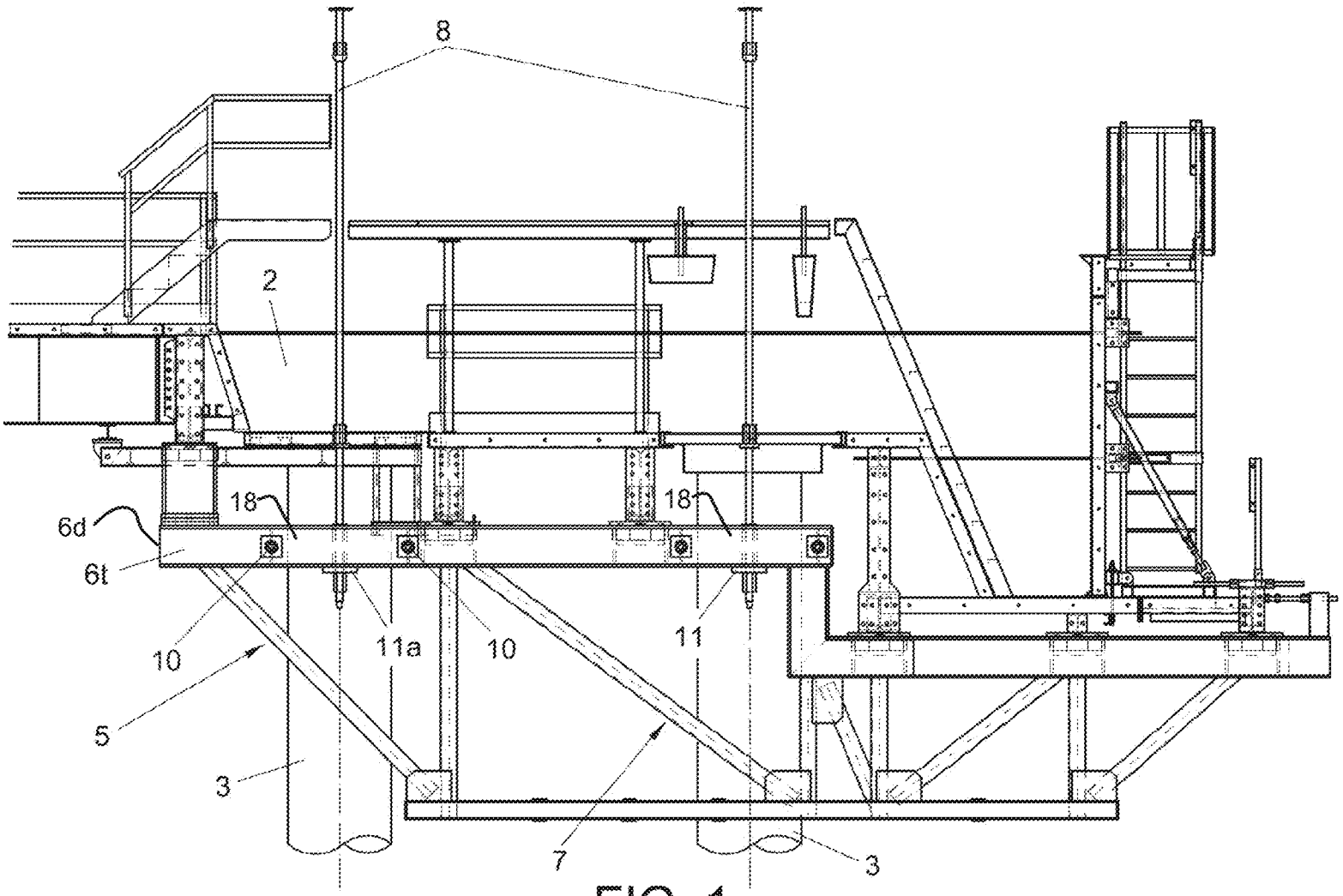
FIG. 1 shows a view from the rear portion of the centring, which is the object of the invention.
Figure 2:
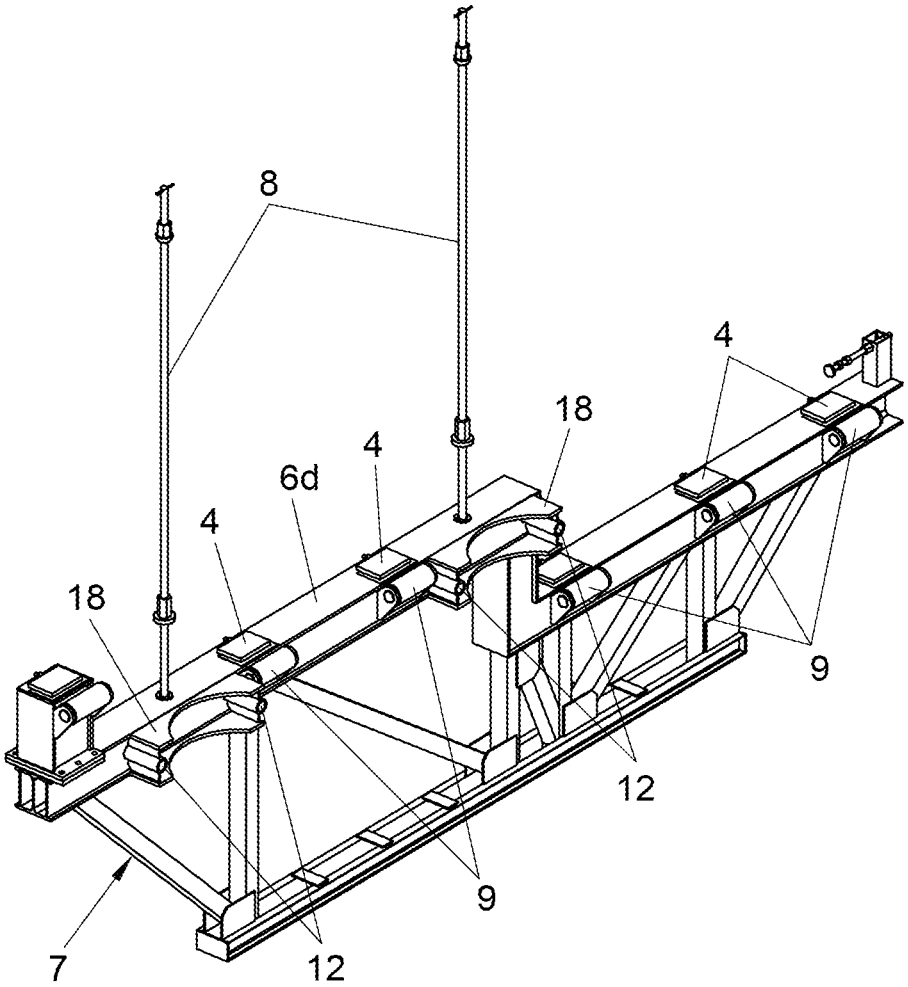
FIG. 2 shows a view in perspective of the front supporting beam.

As it has already been pointed out, and as can be observed in the figures, the centring which is the object of the invention (observable in FIG. 1) comprises a mobile structure (1) which comprises various formworks (2), said mobile structure (1) being supported on piles (3). The fastening of the mobile structure to the piles (3) is done by means of, at least, two supporting devices (5).

Figure 3:
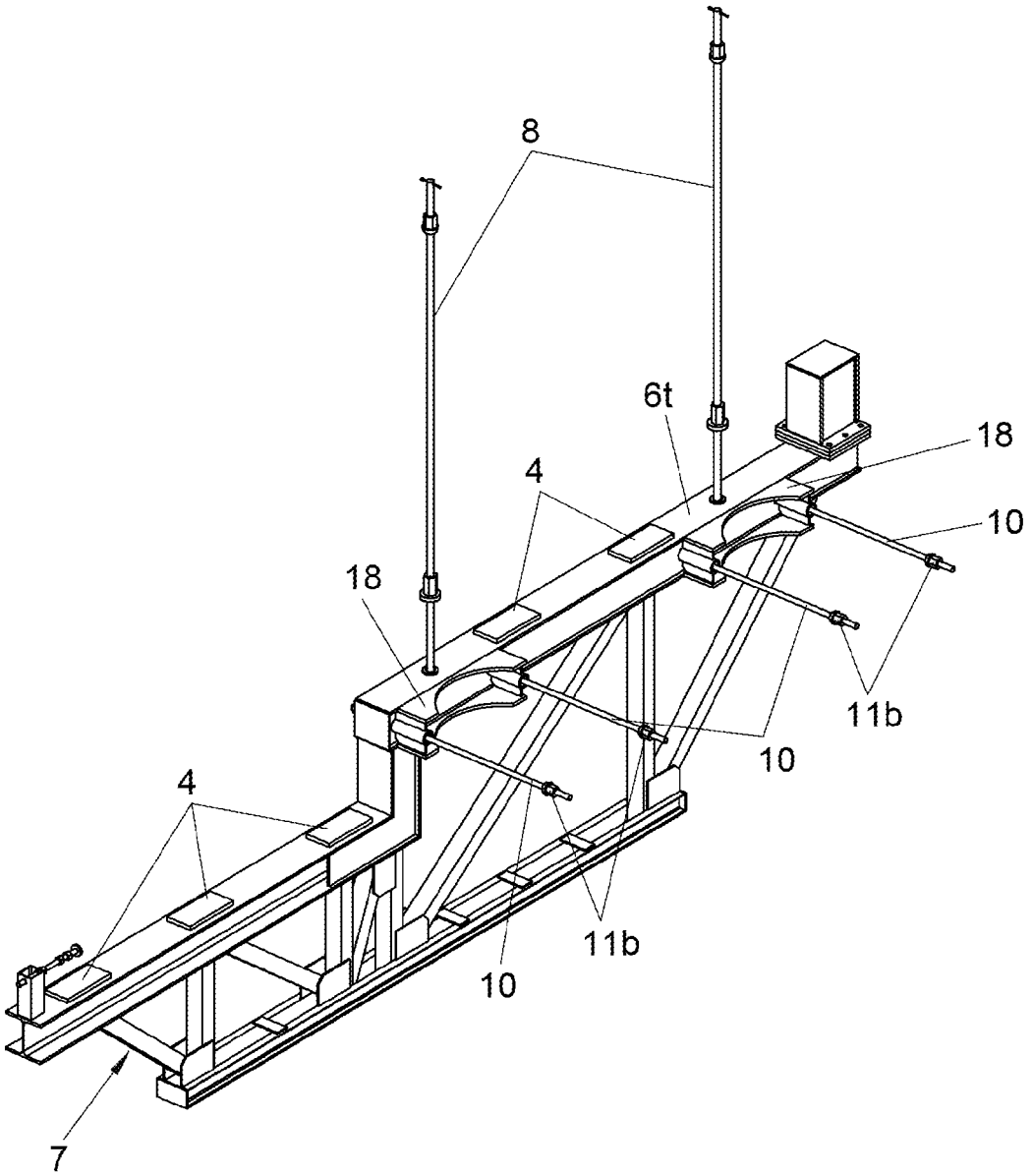
FIG. 3 shows a view in perspective of the rear supporting beam.
Figure 4:
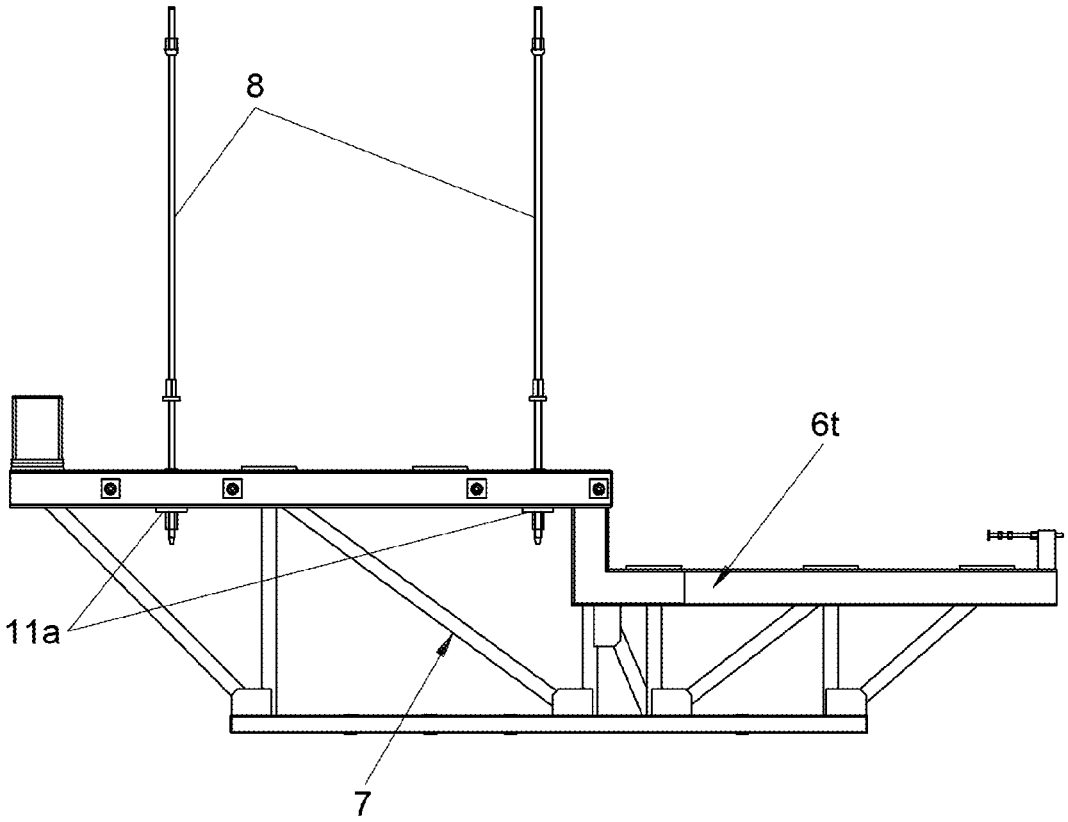
FIG. 4 shows a front view of the rear supporting beam.
Figure 5:
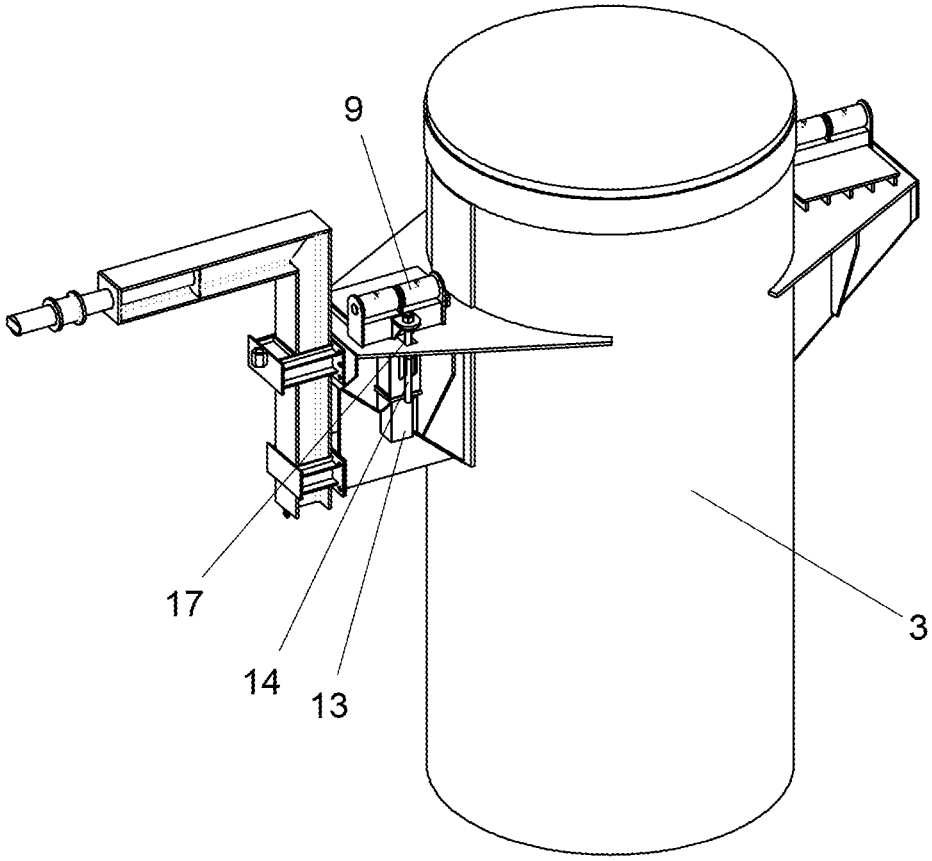
FIG. 5 shows a view in perspective of the height regulation mechanism of the advance rollers.

Each supporting device (5) comprises:
- a front supporting beam (6*d*) (observable in FIG. 3);
- a rear supporting beam (6*t*) (observable in FIGS. 4 and 5);
- a lattice (7), beneath each supporting beam (6*d*, 6*t*) which provides rigidity to the supporting beam (6*d*, 6*t*).

Each supporting beam (6*d*, 6*t*) comprises:
- at least two coupling pieces (18) by means of which the supporting device (5) is fixed to the pile (3);
- at least two vertical latching bars (8) by means of which the mobile structure (1) is hung on the already concreted platform;
- supporting plates (4) located on the supporting beam (6);
- nuts (11*a*) located at the lower face of the supporting beam (6*d*, 6*t*) into which the vertical latching bars (8) are screwed.

The front supporting beams (6*d*) comprise in addition to the aforementioned elements, advance rollers (9) located next to the supporting plates (4). In the case of the front supporting beams (6*d*), the supporting plates (4) are removable.

The coupling pieces (18) are pieces which reproduce at least partially the external geometry of the pile (3), thus two opposite coupling pieces (18) are joined together, and fix the supporting beams (6*d*, 6*t*), of which they are part, to the pile (3), thus constituting a supporting device (5) for the various formworks (2).

Two opposite coupling pieces (18) fix their relative position by means of nuts (11*b*) screwed into tying bars (10), said tying bars (10) passing through threaded holes (12) comprised by the coupling pieces (18).

Therefore, by fixing the coupling pieces (18) together it is possible in each pair of piles (3) to establish a supporting device (5) made up by two supporting beams (6), on which the mobile structure (1) is supported by means of the supporting plates (4) in static position or by means of the rollers (9) during the movement of the mobile structure (1).

With the mobile structure (1) supported on the supporting plates (4) of the supporting beams (6*d*, 6*t*), that is to say in static position, the concreting of a section of the platform is carried out.

To remove the formwork, in the preferred embodiment of the movable centring, a method is employed which comprises at least:
- loosening the nuts (11*b*) of the tying bars (10), so the supporting beams (6*d*, 6*t*) are free to move,
- the front supporting beam (6*d*) is lowered, by means of the vertical latching bars (8) comprised in the aforementioned front supporting beam (6*d*),
- the supporting plates (4) of the front supporting beam (6*d*) are removed, because in this front supporting beam (6*d*) said supporting plates (4) are removable,
- the rear supporting beam (6*t*) is lowered until the mobile structure (1) is supported on the advance rollers (9), by means of the vertical latching bars (8) comprised in the aforementioned rear supporting beam (6*t*).

Figure 6:
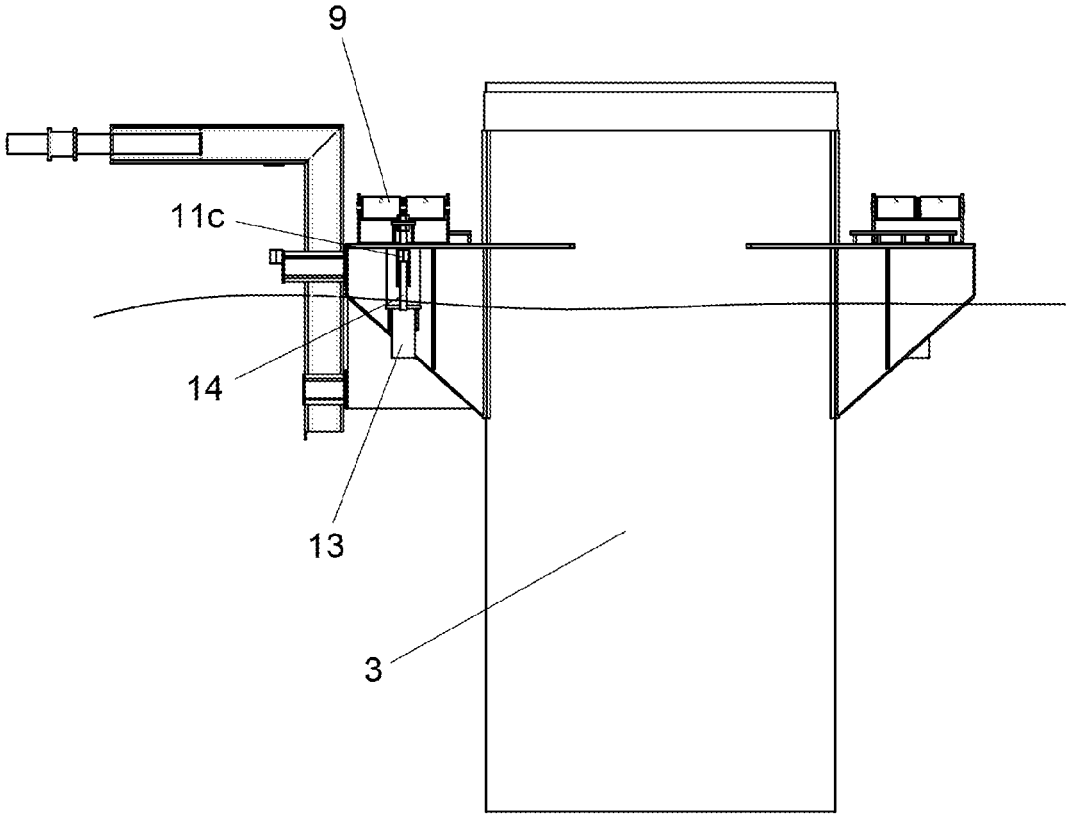
FIG. 6 shows a front view of the height regulation mechanism of the advance rollers.
Figure 7:
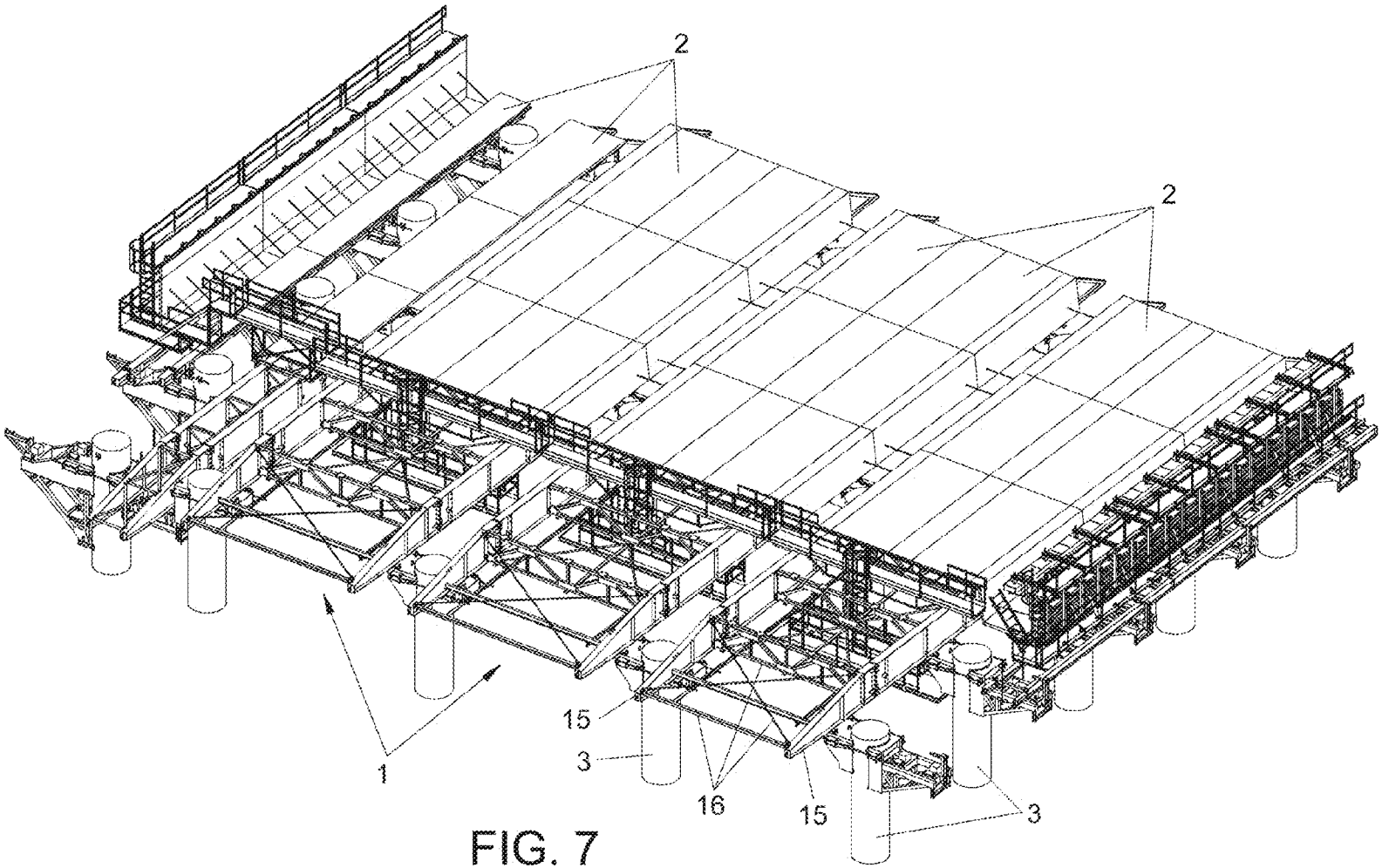
FIG. 7 PRIOR ART
FIG. 7 shows a view in perspective of a state of the art centring.

The advance rollers (9), in the preferred embodiment of the invention, comprise a height regulation mechanism (observable in FIGS. 6 and 7) by means of which it is possible to adapt the height to which the mobile structure (1) is lowered during formwork removal and the advancing process of the mobile structure (1), so that the advance of the mobile structure (1) is homogeneous and without hits or jumps, adapting the height of the advance rollers (9) depending on the position of the mobile structure (1).

The height regulation mechanism of the advance rollers (9) comprises:
- a track (13), at the end of which the advance roller (9) is located,
- a through hole (17) located at the front supporting beam (6*d*),
- a threaded bar (14) joined to the track (13), and which is introduced into a through hole (17) in the front supporting beam (6*d*).

The regulation of the height of the advance rollers (9) is carried out by blocking the relative position of the track (13) with regard to the front supporting beam (6*d*), by screwing a nut (11*c*) onto the end of the threaded bar (14) which passes through the through hole (17).

The mobile structure (1) comprises pairs of longitudinal beams (15) brought together by means of a group of trusses (16) which make the mobile structure (1) rigid, in such a way that such longitudinal beams (15) lean against either the supporting plates (4) or the advance rollers (9), as the case may be at that moment, said longitudinal beams (15) leaning against supporting devices (5) located at two adjacent alignments of piles (3).

The invention must not be limited to the particular embodiment described in this document. Those skilled in the art may develop other embodiments in view of the description made herein. Accordingly, the scope of the invention is defined by the following claims.

The invention claimed is:

1. A movable centring for supporting formworks used for the construction of platforms in ports, comprising:
- a) a mobile structure for supporting the formworks;
- b) at least two supporting devices for supporting the mobile structure, wherein each supporting device comprises:
  - i) a front supporting beam;
  - ii) a rear supporting beam;
  - iii) at least two coupling pieces between the front supporting beam and the rear supporting beam, each coupling piece having a face for contacting an external surface of a pile;
  - iv) a plurality of tying bars adjacent to the at least two coupling pieces, joining the front supporting beam and the rear supporting beam such that when the tying bars are tightened, drawing the front supporting beam toward the rear supporting beam, the faces of the at least two opposing coupling pieces grip the external surface of a pile, fixing the front supporting beam and rear supporting beam to the pile;

v) a lattice beneath each of the front supporting beam and the rear supporting beam, for providing rigidity to the each of the front supporting beam and the rear supporting beam;

c) at least two vertical latching bars for suspending the at least two supporting devices from a completed portion of the platform, joining the front supporting beam of a supporting device and the rear supporting beam of a supporting device to the completed portion of the platform, a vertical position of the front supporting beam and the rear supporting beam of the supporting devices being movable relative to the completed portion of the platform by adjusting the vertical latching bars;

d) a plurality of supporting plates mounted on the front supporting beam and the rear supporting beam, for holding the mobile structure in a static position relative to the supporting devices; and e) a plurality of advance rollers mounted on the front supporting beam adjacent to the plurality of supporting plates, for supporting the mobile structure during movement of the mobile structure relative to the supporting devices.

2. The movable centring of claim 1, in which the vertical latching bars are coupled to the front supporting beam and the rear supporting beam by at least two nuts into which the vertical latching bars are screwed, so that a vertical position of the front supporting beam and the rear supporting beam can be moved in a vertical direction by means of a rotating movement of the vertical latching bars.

3. The movable centring of claim 1, in which the faces of the coupling pieces reproduce at least partially the external geometry of a pile.

4. The movable centring of claim 3, in which the coupling pieces comprise threaded holes into which an end of the tying bars are threaded, and nuts threaded the tying bars for blocking, relative movement of the tying bars in the coupling pieces.

5. The movable centring of claim 1, in which the advance rollers are mounted to the front supporting beam by a height regulation mechanism, which comprises:

a) a track, at the end of which the advance roller is located;

b) a through hole located at the front supporting beam;

c) a threaded bar joined to the track at one end and passing through the through hole of the front supporting beam at an opposite end;

such that the track is blocked by screwing a nut onto the end of the threaded bar which passes through the through hole.

6. The movable centring of claim 1, in which the mobile structure comprises pairs of longitudinal beams brought together by trusses, said longitudinal beams contacting the supporting plates of the supporting devices in a static position and contacting the advance rollers of the front supporting beam of the supporting devices during movement of the mobile structure.

* * * * *